US010277967B2

(12) United States Patent
Satoh et al.

(10) Patent No.: US 10,277,967 B2
(45) Date of Patent: Apr. 30, 2019

(54) PIEZOELECTRIC SOUNDING BODY

(71) Applicant: TDK Corporation, Minato-ku, Tokyo (JP)

(72) Inventors: Akira Satoh, Tokyo (JP); Kaoru Kijima, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 15/234,612

(22) Filed: Aug. 11, 2016

(65) Prior Publication Data

US 2017/0047502 A1 Feb. 16, 2017

(30) Foreign Application Priority Data

Aug. 11, 2015 (JP) ..... 2015-159035

(51) Int. Cl.

| | |
|---|---|
| ***H04R 1/00*** | (2006.01) |
| ***H04R 1/06*** | (2006.01) |
| ***G10K 9/122*** | (2006.01) |
| ***G10K 9/22*** | (2006.01) |
| ***H04R 17/00*** | (2006.01) |

(52) U.S. Cl.

CPC ..... *H04R 1/06* (2013.01); *G10K 9/122* (2013.01); *G10K 9/22* (2013.01); *H04R 17/00* (2013.01); *H04R 2499/13* (2013.01)

(58) Field of Classification Search

CPC ..... H01L 41/047; H04R 17/00; H04R 1/06

See application file for complete search history.

(56) References Cited

U.S. PATENT DOCUMENTS

| | | | | |
|---|---|---|---|---|
| 4,947,075 | A * | 8/1990 | Maury | H04R 1/06 310/324 |
| 6,587,567 | B1 * | 7/2003 | Yamamoto | H04R 1/06 381/190 |
| 6,791,241 | B1 | 9/2004 | Ikegami | |
| 6,807,282 | B2 * | 10/2004 | Kaneda | B06B 1/045 381/396 |
| 2001/0004180 | A1 * | 6/2001 | Kishimoto | H04R 1/06 310/324 |

(Continued)

FOREIGN PATENT DOCUMENTS

| | | |
|---|---|---|
| CN | 1242922 A | 1/2000 |
| CN | 1111950 C | 6/2003 |

(Continued)

*Primary Examiner* — Matthew A Eason

(74) *Attorney, Agent, or Firm* — Arent Fox LLP

(57) ABSTRACT

A piezoelectric sounding body includes: a piezoelectric vibrating plate; a case housing the piezoelectric vibrating plate; a first conductive terminal electrically connected to one electrode in the piezoelectric vibrating plate; and a second conductive terminal electrically connected to the other electrode in the piezoelectric vibrating plate. At least one of the first conductive terminal and the second conductive terminal includes: a first terminal portion arranged inside the case; a second terminal portion arranged on the outside of the case; and a third terminal portion arranged in a terminal insertion hole formed in the case to connect the first terminal portion and the second terminal portion. The first terminal portion includes a sandwiching portion configured to sandwich part of the case between the first terminal portion and the second terminal portion.

20 Claims, 8 Drawing Sheets

(56) References Cited

U.S. PATENT DOCUMENTS

| | | | | |
|---|---|---|---|---|
| 2003/0021458 | A1* | 1/2003 | Hamada | B06B 1/0603 382/135 |
| 2003/0034714 | A1* | 2/2003 | Takeshima | H04R 1/06 310/324 |
| 2004/0080241 | A1* | 4/2004 | Ikegami | H03H 9/0519 310/311 |
| 2009/0285439 | A1* | 11/2009 | Yuasa | H04R 1/06 381/412 |

FOREIGN PATENT DOCUMENTS

| | | | |
|---|---|---|---|
| CN | 1218550 | C | 9/2005 |
| JP | H11-52958 | A | 2/1999 |

* cited by examiner

PIEZOELECTRIC SOUNDING BODY

BACKGROUND OF THE INVENTION

1. Field of the Invention

The present invention relates to a piezoelectric sounding body that generates a certain sound by vibration of a piezoelectric vibrating plate.

2. Description of the Related Art

For example, in the likes of an automobile or various kinds of household electrical appliances, a piezoelectric sounding body is sometimes adopted as a sounding body that generates a buzzer sound or the like. The piezoelectric sounding body applies a cyclical voltage signal to a piezoelectric vibrating plate, thereby vibrating the piezoelectric vibrating plate and generating a specific sound (for example, a warning sound, and so on) that attracts the attention of a user, or the like.

In the piezoelectric sounding body, the piezoelectric vibrating plate is housed in a case, and a lead terminal connected to the piezoelectric vibrating plate passes through a through hole provided in the case and is thereby led out to the outside of the case (see Patent Document 1).

Patent Document 1: JP H11-52958 A

SUMMARY OF THE INVENTION

In a conventional piezoelectric sounding body, there occurred the problem that when an impact is applied to a portion led out to the outside of the case of the lead terminal, the impact is transmitted to a portion housed on the inside of the case of the lead terminal, and there occurs a positional misalignment of the lead terminal, or damage or a conductive malfunction of a joining portion between the lead terminal and another component (for example, the piezoelectric vibrating plate). The positional misalignment of the lead terminal or damage of the joining portion, and so on, sometimes change the likes of sound pressure relating to a sound generated by the piezoelectric sounding body, and quality improvement has become required from a viewpoint of reliability, durability, and so on, of the piezoelectric sounding body.

The present invention has been made in view of such circumstances. It is an object of the invention to provide a piezoelectric sounding body capable of preventing an external force applied to a portion arranged on the outside of a case of a conductive terminal from being transmitted to the inside of the case and a positional misalignment of a member on the inside of the case or a joining malfunction from occurring.

In order to achieve the above object, a piezoelectric sounding body according to the present invention comprises:

a piezoelectric vibrating plate;

a case housing the piezoelectric vibrating plate;

a first conductive terminal electrically connected to one electrode in the piezoelectric vibrating plate; and a second conductive terminal electrically connected to the other electrode in the piezoelectric vibrating plate, wherein at least one of the first conductive terminal and the second conductive terminal including:

a first terminal portion arranged inside the case;

a second terminal portion arranged on the outside of the case; and a third terminal portion arranged in a terminal insertion hole formed in the case to connect the first terminal portion and the second terminal portion, and the first terminal portion includes a sandwiching portion configured to sandwich part of the case between the first terminal portion and the second terminal portion.

The piezoelectric sounding body according to the present invention sandwiches part of the case by the first terminal portion arranged on the inside of the case and the second terminal portion arranged on the outside of the case, hence even if an external force such as an impact is applied to the second terminal portion, that external force can be preferably received by the case. Thus, even in the case when an external force is applied to the second terminal portion, it is possible to prevent problems such as the first terminal portion moving, or a joining portion between the first terminal portion and another component being damaged, and it is possible to prevent the likes of a change in sound pressure accompanying those problems, hence the piezoelectric sounding body according to the present invention displays high reliability and durability performance.

For example, the first terminal portion may include: a contacting part configured to extend in the same plane as the sandwiching portion and be fixed in a caulking manner so as to contact an inner wall surface of the case; and a contact-point part configured to connect the contacting part and the piezoelectric vibrating plate.

The contacting part that extends the same plane as the sandwiching portion is fixed to the inner wall surface of the case, whereby even if an external force such as an impact is applied to the second terminal portion, that external force can be more preferably received by the case, the external force can be prevented from being transmitted to a joining part, and connection between the piezoelectric vibrating plate and the joining part can be prevented from being damaged. Moreover, the contacting part is fixed in a caulking manner, hence fixing of the case and the contacting part is easy and has high reliability.

For example, the contact-point part may extend a direction crossing a first direction defined as an arrangement direction of the sandwiching portion and the contacting part when the first terminal portion is viewed from a normal direction of an arrangement surface of the sandwiching portion and the contacting part.

By the contact-point part extending in a direction intersecting the first direction, it is possible to increase a length from a portion fixed in a caulking manner to an edge of the contact-point part, whereby appropriate springiness can be provided to the contact-point part. Moreover, the problem of a caulking projection interfering with a movable range of the contact-point part to cause a defective product, can be reduced.

For example, the contacting part may be in contact with a portion of the inner wall surface positioned at one side to the terminal insertion hole, and the sandwiching portion may be in contact with a portion of the inner wall surface positioned at the other side to the terminal insertion hole.

The sandwiching portion sandwiches the case between itself and the second terminal portion and the contacting part is fixed in a caulking manner to the inner wall surface, hence in this kind of piezoelectric sounding body, the first terminal portion arranged on both sides sandwiching the terminal insertion hole is supported by the case on both sides. Thus, the case can preferably receive an external force transmitted via the second terminal portion and the third terminal portion, hence problems of a position of the first terminal portion being misaligned or connection between the contact-point part and the piezoelectric vibrating plate being released by the external force, can be reliably prevented.

For example, the contact-point part may have a shape configured to become narrower from the contacting part toward the piezoelectric vibrating plate.

Configuring the contact-point part to have a shape that narrows toward the piezoelectric vibrating plate side makes it possible for flexibility of the contact-point part to be raised, and for conduction to be secured in a state where vibration of the piezoelectric vibrating plate is not hindered. Moreover, even in the case when an external force that was unable to be received by the case has been transmitted to the contact-point part, the narrowed contact-point part elastically deforms, whereby the external force can be prevented from being transmitted to a more extreme portion than a deformed place, and the problem of damage, and so on, occurring in a joining portion between the contact-point part and the piezoelectric vibrating plate, can be prevented.

For example, a caulking projection configured to form a plurality of fixing holes on the contacting part and to fix the contacting part to the inner wall surface may be inserted into the fixing hole.

In the piezoelectric sounding body that has caulking projections inserted through a plurality of fixing holes formed in the contacting part, the problem of a fixed terminal rotating by an external force, and so on, can be effectively prevented. Moreover, when attaching a conductive terminal to the case, the conductive terminal can be simply arranged in a correct position merely by inserting the caulking projection prior to its edge being deformed, in the fixing hole of the contacting part, hence this kind of piezoelectric sounding body can be easily manufactured.

For example, the second terminal portion may include: a downside part configured to be parallel to the sandwiching portion and to contact an outer wall surface of the case; and a lateral part configured to be parallel to the third terminal portion and to contact the outer wall surface.

Such a conductive terminal of the piezoelectric sounding body has a shape that not only sandwiches the case between the sandwiching portion and the downside part, but sandwiches the case also between the third terminal portion and the lateral part, hence the first terminal portion excluding the joining part and the second terminal portion and third terminal portion reliably sandwich part of the case. In such a piezoelectric sounding body, even if an external force is applied to the second terminal portion, that external force can be more preferably received by the case, the external force can be prevented from being transmitted to the joining part, and connection between the piezoelectric vibrating plate and the joining part can be prevented from being damaged.

For example, a through hole corresponding to a shape of the sandwiching portion may be formed on the third terminal portion.

The conductive terminal having such a shape can be easily formed by mechanically processing a single metal plate, for example, and, moreover, does not have a joining portion resulting from welding or the like, hence has high strength and excellent durability.

For example, the case may include: a lower case where the first conductive terminal and the second conductive terminal are fixed; and an upper case configured to be fixed in a caulking manner to the lower case and to sandwich the piezoelectric vibrating plate between the upper case and the lower case.

The piezoelectric sounding body in which the piezoelectric vibrating plate is held sandwiched between an upper case and a lower case, and in which the upper case and the lower case are fixed in a caulking manner differs from the conventional technology adopting a method of fixing in which the upper case and the lower case are fitted using flexible deformation of the case, and is almost immune to joining of the upper case and the lower case being released, even when heat is applied. Thus, this kind of piezoelectric sounding body is capable of efficient mounting on a substrate, and so on, by surface mounting due to reflow, or the like.

DESCRIPTION OF THE PREFERRED EMBODIMENTS

Figure 1:
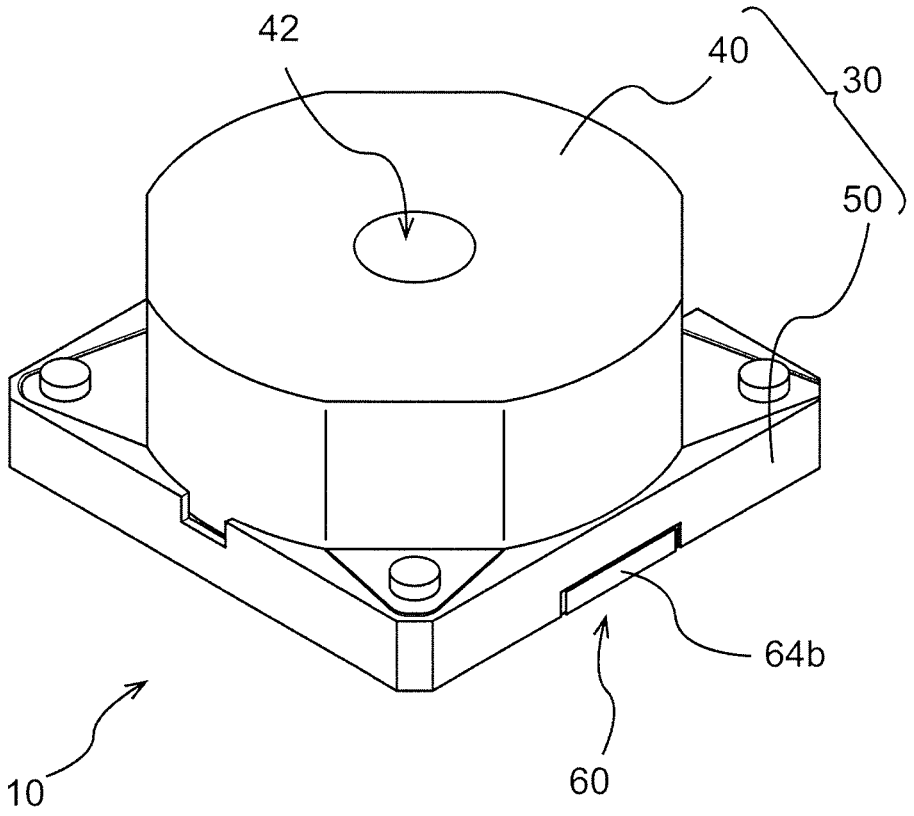
FIG. 1 is a schematic view of a piezoelectric sounding body according to an embodiment of the present invention.

The present invention will be described below based on an embodiment shown in the drawings.

FIG. 1 is a schematic perspective view of a piezoelectric sounding body 10 according to an embodiment of the present invention. As shown in FIG. 1, the piezoelectric sounding body 10 includes a case 30 configured by an upper case 40 and a lower case 50. The case 30 houses a piezoelectric vibrating plate 20 shown in FIG. 2 and a first conductive terminal 60 and a second conductive terminal 70 that are electrically connected to electrodes of the piezoelectric vibrating plate 20. As shown in FIG. 1, other parts of the first conductive terminal 60 and the second conductive terminal 70 are exposed to the outside of the case 30.

Figure 2:
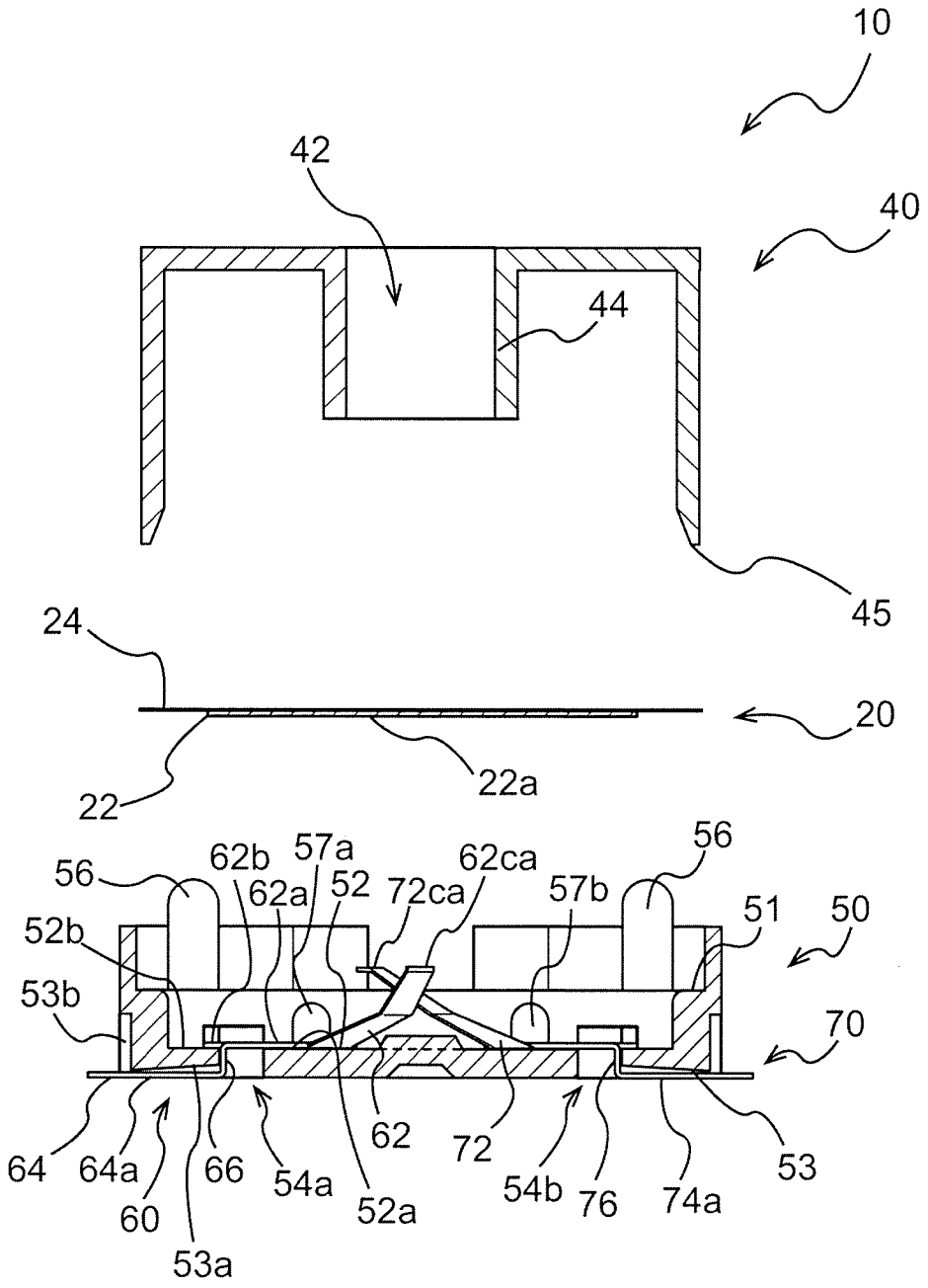
FIG. 2 is an exploded cross-sectional view of the piezoelectric sounding body shown in FIG. 1.

FIG. 2 is an exploded cross-sectional view of the piezoelectric sounding body 10 shown in FIG. 1. The piezoelectric vibrating plate 20 has an outer shape of circular plate. The piezoelectric vibrating plate 20 has a two-layer structure in which a piezoelectric body 22 and a vibrating plate 24 both having a circular plate shape are concentrically stacked, and the vibrating plate 24 arranged upwardly has a larger diameter than the piezoelectric body 22 arranged downwardly.

The vibrating plate 24 functions as one electrode of the piezoelectric vibrating plate 20. The other electrode 22*a* of the piezoelectric vibrating plate 20 is formed on a lower surface of the piezoelectric body 22. Moreover, the vibrating plate 24 as one electrode and the other electrode 22*a* are insulated, and a voltage is applied to the piezoelectric body 22 via the vibrating plate 24 and the other electrode 22*a*. The piezoelectric body 22 is made of any material with an electrode formed on a piezoelectric material, and is configured, for example, by forming the electrode 22*a*, such as Ag, on the likes of ferroelectric ceramics, such as PZT (lead zirconate titanate). The vibrating plate 24 is also made of any material, such as metal material of brass, Ni alloy, or the like. Note that the vibrating plate 24 may be joined to the piezoelectric body 22 via a base electrode, such as Ag, formed on the surface of the piezoelectric body 22.

As shown in FIG. 1 and FIG. 2, the upper case 40 has a substantially hollow cylindrical outer shape where a sound emitting hole 42 is formed on its upper center. As shown in FIG. 2, an edge part of the sound emitting hole 42 configures a cylindrical part 44 protruding downwardly, and the cylindrical part 44 is arranged inside the upper case 40. An opening diameter of the sound emitting hole 42 or protrusion length of the cylindrical part 44 is properly adjusted based on the likes of a pitch of sound generated by the piezoelectric sounding body 10.

The upper case 40 has any diameter of its periphery, such as about 10 to 30 mm. Moreover, the upper case 40 has also any height, such as about 3 to 15 mm.

Figure 7:
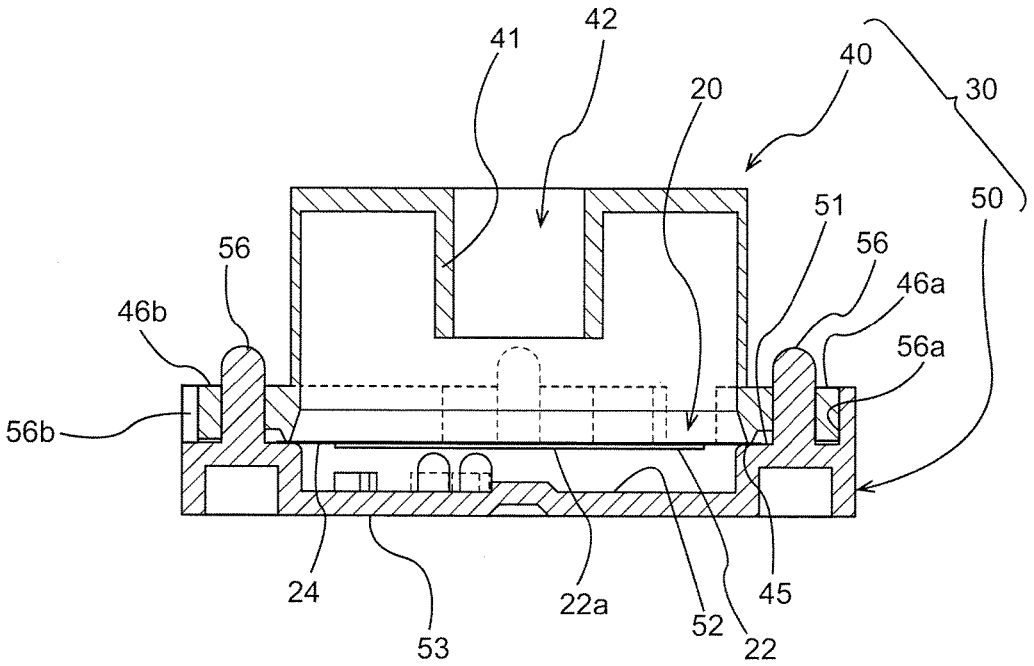
FIG. 7 is a cross-sectional view showing an assembled state of an upper case, a piezoelectric vibrating plate, and the lower case.

A contact projection 45 is formed along the circumferential direction of the lower end of the upper case 40. As shown in FIG. 7, which displays an assembled state of the upper case 40, the lower case 50, and the piezoelectric vibrating plate 20, the contact projection 45 of the upper case 40 fixes the piezoelectric vibrating plate 20 by pressing it onto a lower case step part 51 formed in the lower case 50. Note that FIG. 7 does not illustrate the first conductive terminal 60 or the second conductive terminal 70 shown in FIG. 2.

Engaging parts 46*a* and 46*b* projecting toward the outer diameter direction are formed at four places in an outer periphery of the upper case 40. An insertion hole for inserting a case caulking projection 56 provided on the lower case 50 is formed in the respective engaging parts 46*a* and 46*b*. The upper case 40 is fixed to the lower case 50 due to caulking by inserting the case caulking projection 56 into the insertion hole of the engaging parts 46*a* and 46*b*.

Figure 4:
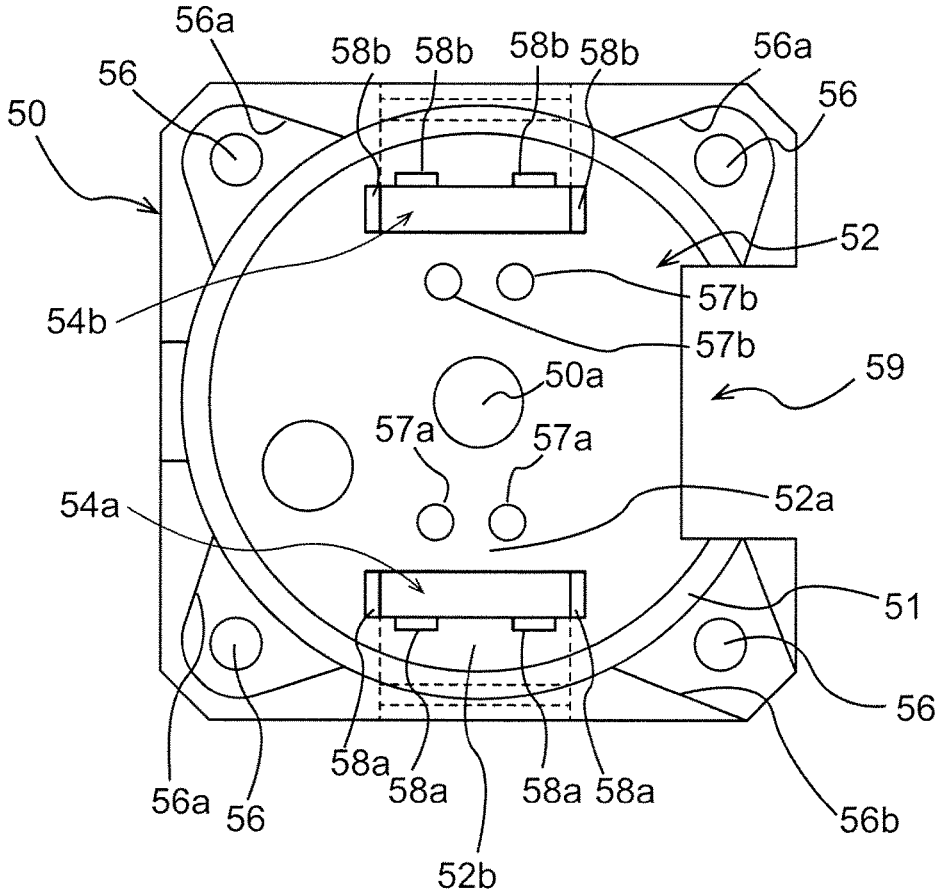
FIG. 4 is a plan view showing the lower case prior to assembly used for the piezoelectric sounding body shown in FIG. 1.

FIG. 4 is a plan view of the lower case 50. As shown in FIG. 4, the lower case 50 has a substantially rectangular outer shape when viewed from above. The four corners of the lower case 50 are provided with the case caulking projections 56 for fixing the upper case 40 to the lower case 50 in a caulking manner.

Guide parts 56*a* and 56*b* engaged with the engaging parts 46*a* and 46*b* of the upper case 40 are formed on the periphery of the four case caulking projections 56. The engaging parts 46*a* and 46*b* of the upper case 40 and the guide parts 56*a* and 56*b* of the lower case 50 have shape corresponding to each other. The upper case 40 and the lower case 50 are combined in a correct position, so that the engaging parts 46*a* and 46*b* of the upper case 40 are engaged with the guide parts 56*a* and 56*b* of the lower case 50, and the case caulking projections 56 of the lower case 50 are inserted through the insertion holes formed in the engaging parts 46*a* and 46*b* of the upper case 40.

At least one pair of the guide part 56*b* and the engaging part 46*b* of the corresponding four pairs of the guide parts 56*a* and 56*b* and the engaging parts 46*a* and 46*b* have a different shape from the other guide parts 56*a* and engaging parts 46*a*. This prevents the engaging parts 46*a* and 46*b* from engaging with the guide parts 56*a* and 56*b* when attempting to combine the upper case 40 and the lower case 50 in an incorrect position (see FIG. 4 and FIG. 7).

As shown in FIG. 4, a first terminal insertion hole 54*a* and a second terminal insertion hole 54*b* are formed on the bottom surface of the lower case 50. The first conductive terminal 60 (see FIG. 2 and FIG. 5A) passes through the first terminal insertion hole 54*a*. The second conductive terminal 70 (see FIG. 2 and FIG. 5B) passes through the second terminal insertion hole 54*b*. The first terminal insertion hole 54*a* and the second terminal insertion hole 54*b* penetrate the lower case 50 from a lower case inner wall surface 52 to a lower case outer wall surface 53, which is an outer wall surface of the lower case 50 (see FIG. 2).

The first terminal insertion hole 54*a* and the second terminal insertion hole 54*b* have a substantially rectangular opening shape, and are arranged substantially symmetrically to each other, having a center 50*a* of the lower case 50 as a symmetric axis. Terminal caulking projections 57*a* for fixing the first conductive terminal 60 to the lower case 50 are formed in an inner wall first portion 52*a*, which is the lower case inner wall surface 52 from the first terminal insertion hole 54*a* to the center 50*a*. A plurality (two in the embodiment) of the terminal caulking projections 57*a* is formed in the inner wall first portion 52*a*.

Moreover, a plurality of (four in the embodiment) auxiliary caulking projections 58*a* is formed on an opening edge at the side of the lower case inner wall surface 52 of the first terminal insertion hole 54*a*. The auxiliary caulking projections 58*a* in conjunction with the terminal caulking projections 57*a* fix the first conductive terminal 60 to the lower case 50.

A terminal caulking projection 57*b* for fixing the second conductive terminal 70 to the lower case 50 is formed on the lower case inner wall surface 52 from the second terminal insertion hole 54*b* to the center 50*a*. A plurality of auxiliary caulking projections 58*b* is formed on the lower case inner wall surface 52 along an opening edge of the second terminal insertion hole 54*b*. The number of the terminal caulking projections 57*b* and the auxiliary caulking projections 58*b* for fixing the second conductive terminal 70 is the same as the number of the terminal caulking projections 57*a* and the auxiliary caulking projections 58*a* for fixing the first conductive terminal 60. However, the number of the terminal caulking projections 57*a* and 57*b* and the auxiliary caulking projections 58*a* and 58*b* is not limited to the number shown in the embodiment.

As shown in FIG. 2, the lower case step part 51 for mounting a circumferential portion of the piezoelectric vibrating plate 20 is formed in the lower case 50. The lower case step part 51 is formed along a circumferential direction of the upper case 40, and has a planar shape corresponding to a shape of the contact projection 45 of the upper case 40. As shown in FIG. 4, the lower case step part 51 is divided by a notch 59 formed in the lower case 50, and hence is not continuous in the circumferential direction. The notch 59 is an air hole provided for being able to appropriately generate sound by the piezoelectric sounding body 10. This air hole has any shape and is positioned anywhere.

The upper case 40 and the lower case 50 can be manufactured by a resin material, such as a liquid crystal polyester resin, a phenol resin, and a polybutylene terephthalate resin. The upper case 40 and the lower case 50 are preferably manufactured by a heat resistant resin so as to be able to endure a thermal load during surface mounting, but are not limited.

As shown in FIG. 2, the first conductive terminal 60 has a first terminal portion 62, a second terminal portion 64, and a third terminal portion 66. The first terminal portion 62 is arranged inside the case 30 shown in FIG. 1. The second terminal portion 64 is arranged outside the case 30. The third terminal portion 66 is arranged in the first terminal insertion hole 54*a* formed in the lower case 50 of the case 30 to connect the first terminal portion 62 and the second terminal portion 64.

Figure 3:
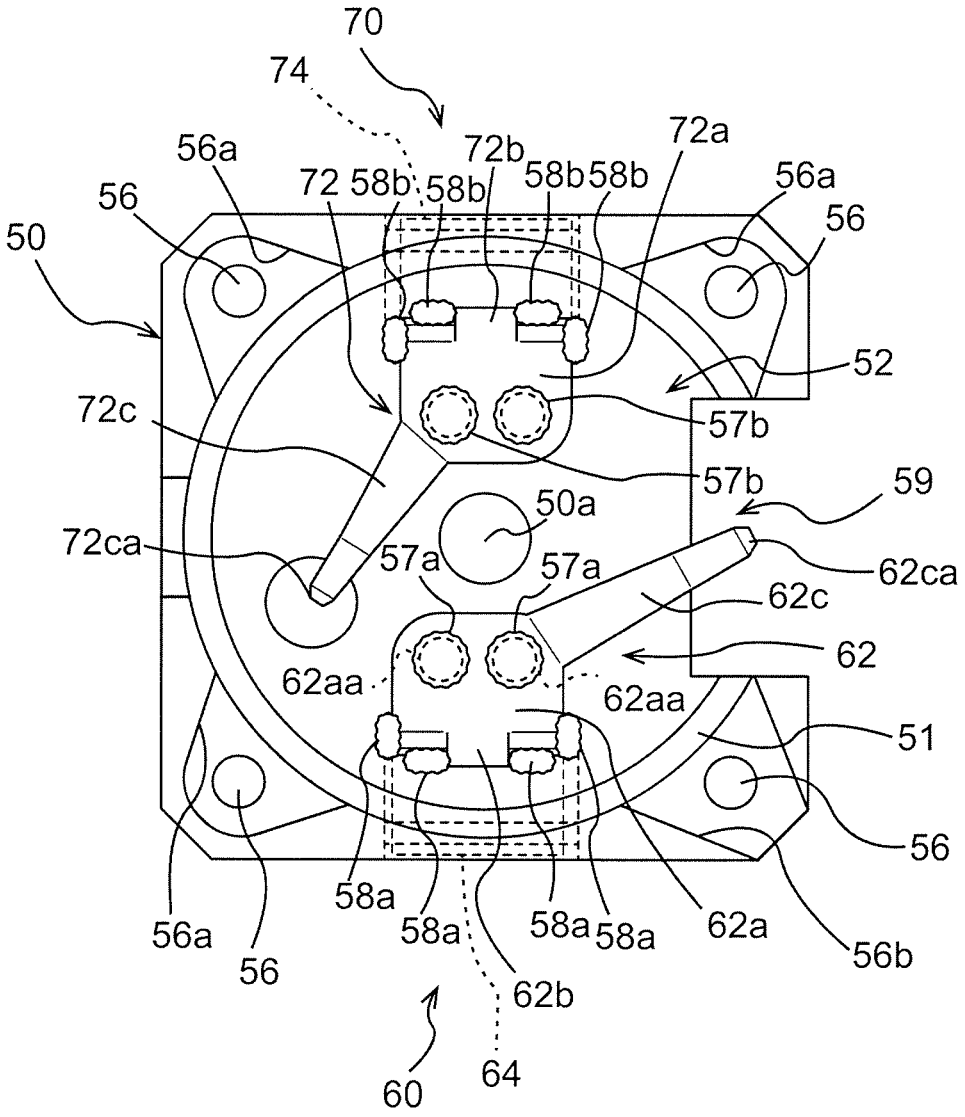
FIG. 3 is a schematic plan view showing a state of a lower case and a conductive terminal of the piezoelectric sounding body shown in FIG. 1 as seen from above.

In an assembled state where the piezoelectric vibrating plate 20 is fixed to the lower case step part 51 (see FIG. 7), a terminal tip 62*ca* of the first conductive terminal 60 is electrically connected to the vibrating plate 24, which is one electrode of the piezoelectric vibrating plate 20. FIG. 3 shows a state where the first conductive terminal 60 and the second conductive terminal 70 are fixed to the lower case 50. The terminal tip 62*ca* of the first conductive terminal 60 is connected to a portion of the piezoelectric vibrating plate 20 where the vibrating plate 24 is visible from below. The terminal tip 62*ca* is fixed to the vibrating plate 24 using the likes of a conductive adhesive agent, for example, but the piezoelectric vibrating plate 20 and the first conductive terminal 60 are connected by any method.

Figure 5A:
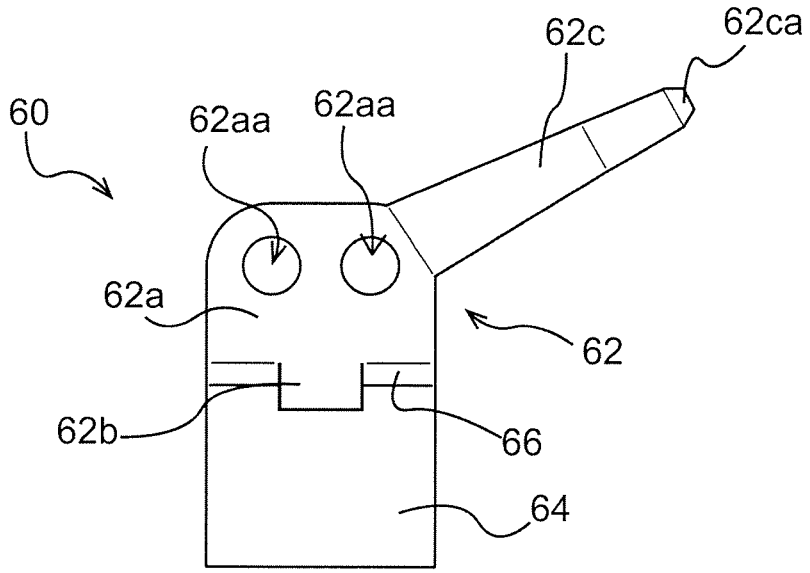
FIG. 5A is a plan view showing a first conductive terminal used for the piezoelectric sounding body shown in FIG. 1.
Figure 6:
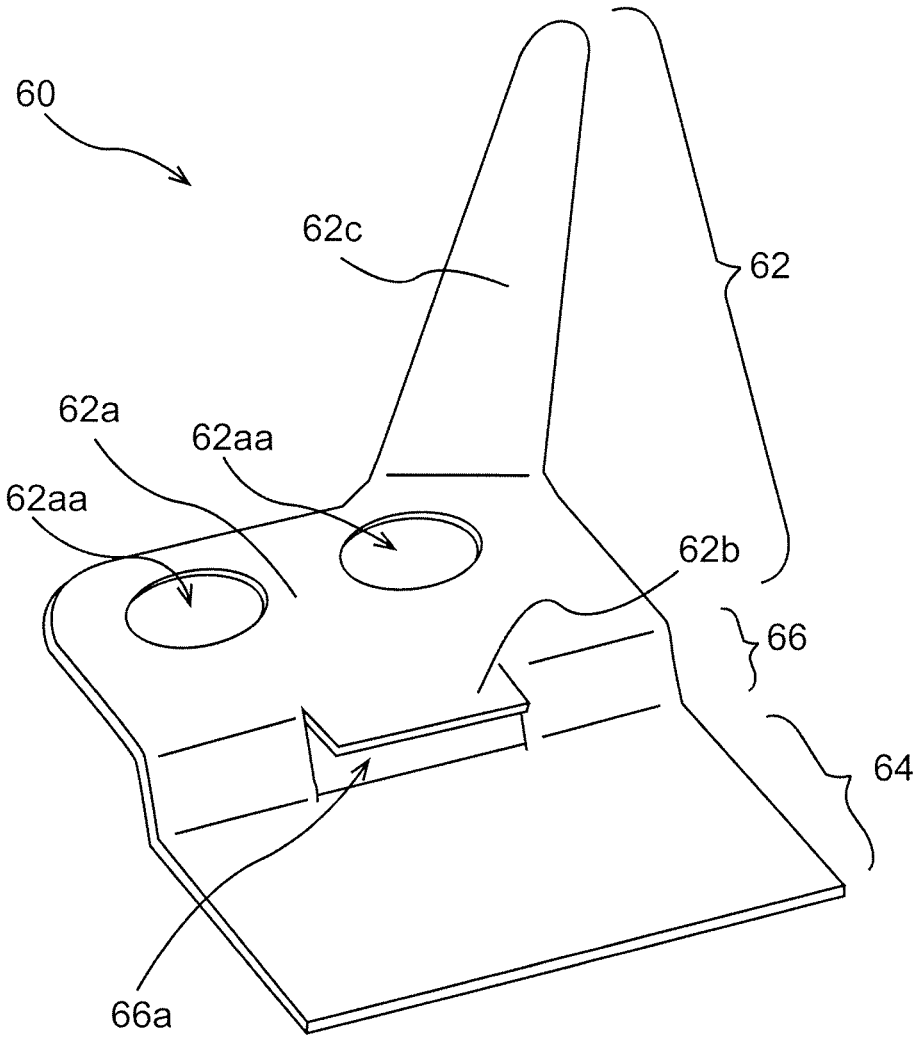
FIG. 6 is a schematic perspective view of the first conductive terminal shown in FIG. 5A.

FIG. 5A is a plan view of the first conductive terminal 60. The first terminal portion 62 of the first conductive terminal 60 has a contacting part 62*a*, a sandwiching portion 62*b*, and a contact-point part 62*c*. As shown in FIG. 2 and FIG. 6, the contacting part 62*a* extends in the same plane as the sandwiching portion 62*b*. As shown in FIG. 5A, a plurality (two in the embodiment) of fixing holes 62*aa* for inserting the terminal caulking projections 57*a* of the lower case 50 is formed on the contacting part 62*a*. As shown in FIG. 2 and FIG. 3, the contacting part 62*a* is fixed in a caulking manner by the terminal caulking projections 57*a* and the auxiliary caulking projections 58*a* so as to contact the lower case inner wall surface 52, which is an inner wall surface of the lower case 50.

Figure 5B:
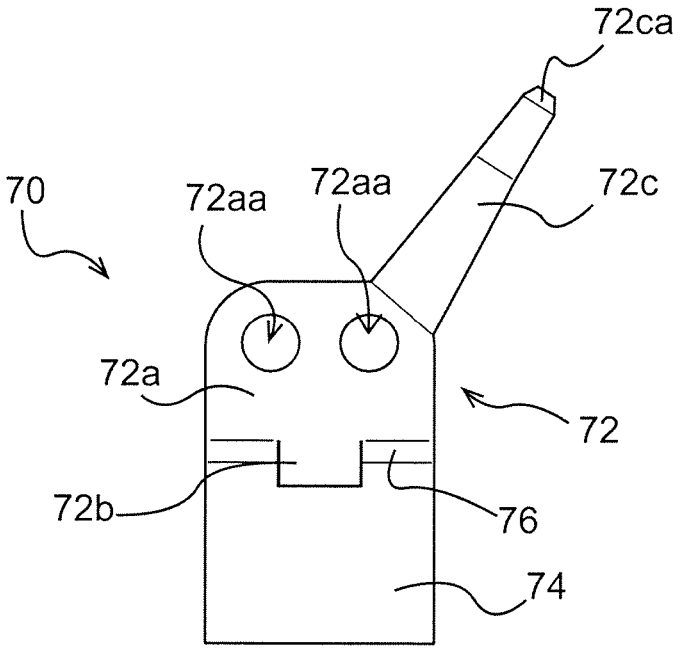
FIG. 5B is a plan view showing a second conductive terminal used for the piezoelectric sounding body shown in FIG. 1.

As shown in FIG. 3, FIG. 5A, and FIG. 5B, the sandwiching portion 62*b* of the first terminal portion 62 is connected to one side of the contacting part 62*a*, is smaller than the contacting part 62*a*, and has a rectangular plate like outer shape. As shown in FIG. 2, the contacting part 62*a* contacts the inner wall first portion 52*a* of the lower case inner wall surface 52 positioned at the side of the center 50*a* (one side) with respect to the first terminal insertion hole 54*a*, and the sandwiching portion 62*b* contacts an inner wall second portion 52*b* of the lower case inner wall surface 52 positioned at the side of the periphery (the other side) with respect to the first terminal insertion hole 54*a*. Note that, as shown in FIG. 3, the auxiliary caulking projections 58*a* may fix the sandwiching portion 62*b* in addition to the contacting part 62*a* of the first terminal portion 62 to the lower case 50 in a caulking manner.

As shown in FIG. 2, the second terminal portion 64 is arranged on the lower case outer wall surface 53 located opposite to the inner wall second portion 52*b* so as to face the lower case outer wall surface 53. At least part of the second terminal portion 64 contacts the lower case outer wall surface 53, and the sandwiching portion 62*b* contacting the inner wall second portion 52*b* sandwiches part of the lower case 50 between itself and the second terminal portion 64.

As shown in FIG. 2, the contact-point part 62*c* extends upwardly with respect to a plane in which the contacting part 62*a* and the sandwiching portion 62*b* are arranged. As shown in FIG. 5, a base end of the contact-point part 62*c* is connected to the contacting part 62*a*, and the terminal tip 62*ca*, which is a tip of the contact-point part 62*c*, is fixed to the piezoelectric vibrating plate 20 shown in FIG. 2. Thus, the contact-point part 62*c* connects the contacting part 62*a* and the piezoelectric vibrating plate 20.

As shown in FIG. 2 and FIG. 5, a bend portion is formed at two places in the contact-point part 62*c*. Moreover, as shown in FIG. 2, in the first terminal portion 62, when an arrangement direction of the sandwiching portion 62*b* and the contacting part 62*a* is assumed to be a first direction and the first terminal portion 62 is viewed in plane from a normal direction to a placement surface of the sandwiching portion 62*b* and the contacting part 62*a*, the contact-point part 62*c* extends in a direction intersecting the first direction. Furthermore, the contact-point part 62*c* has a shape that narrows from its base end on a side of the contacting part 62*a* to the terminal tip 62*ca* on a side of the piezoelectric vibrating plate 20.

As shown in FIG. 6, the third terminal portion 66 is connected to the contacting part 62*a* of the first terminal portion 62. The third terminal portion 66 is connected to the same side of the contacting part 62*a* as the side where the sandwiching portion 62*b* is connected to the contacting part 62*a*, but the third terminal portion 66 is bent downwardly with respect to the contacting part 62*a*, whereas the sandwiching portion 62*b* is arranged in the same plane as the contacting part 62*a*.

As shown in FIG. 6, a through hole 66*a* corresponding to a shape of the sandwiching portion 62*b* is formed on the third terminal portion 66. Note that an entirety of the through hole 66*a* may be formed in the third terminal portion 66, and that part of the through hole 66*a* may be continuous to the second terminal portion 64.

As shown in FIG. 6, the third terminal portion 66 connects the first terminal portion 62 and the second terminal portion 64. As shown in FIG. 2, the third terminal portion 66 is arranged in the first terminal insertion hole 54*a* of the lower case 50.

As shown in FIG. 2, a downside part 64*a* of the second terminal portion 64 bent to connect to the third terminal portion 66 is parallel to the sandwiching portion 62*b*, and at least part of the downside part 64*a* contacts the lower case outer wall surface 53. As shown by the dotted lines in FIG. 4, a downside recess 53*a* is formed on a surface facing downwardly of the lower case outer wall surface 53, and the downside part 64*a* of the third terminal portion 66 is arranged in the downside recess 53*a*.

An end on an opposite side to a side connected to the third terminal portion 66 in the second terminal portion 64 is bent upwardly from the state shown in FIG. 2 and configures a lateral part 64*b* as shown in FIG. 1. As shown in FIG. 2, a lateral recess 53*b* is formed on a surface facing laterally of the lower case outer wall surface 53, and the lateral part 64*b* of the third terminal portion 66 is arranged on the lateral recess 53*b*. The lateral part 64*b* is substantially parallel to the third terminal portion 66 and sandwiches part of the lower case 50 between itself and the third terminal portion 66.

As shown in FIG. 2, the second conductive terminal 70, similarly to the first conductive terminal 60, also includes: a first terminal portion 72 arranged on the inside of the case 30; a second terminal portion 74 arranged on the outside of the case 30; and a third terminal portion 76 that connects the first terminal portion 72 and the second terminal portion 74 and is arranged in the second terminal insertion hole 54*b* formed in the lower case 50 of the case 30.

FIG. 5B is a plan view of the second conductive terminal 70. As understood from a comparison between FIG. 5A and FIG. 5B, the second conductive terminal 70 has common characteristics with the first conductive terminal 60 in many respects. Thus, the second conductive terminal 70 will be explained mainly in terms of differences from the first conductive terminal 60, and common points with the conductive terminal 60 will not be explained.

In the assembled state where the piezoelectric vibrating plate 20 is fixed to the lower case step part 51 (see FIG. 7), a terminal tip 72*ca* of the second conductive terminal 70 is electrically connected to the other electrode 22*a* of the piezoelectric vibrating plate 20. As shown in FIG. 3, the terminal tip 72*ca* of the second conductive terminal 70 is arranged nearer to the center 50*a* than the terminal tip 62*ca* of the first conductive terminal 60, and is connected to a portion of the piezoelectric vibrating plate 20 where the vibrating plate 24 is covered from below by the piezoelectric body 22. The terminal tip 72*ca* of the second conductive terminal 70 is fixed to the other electrode 22*a* using the likes of a conductive adhesive agent.

As shown in FIG. 5B, fixing holes 72*aa*, where the terminal caulking projections 57*a* of the lower case 50 are inserted, are also formed on the second conductive terminal 70, and the second conductive terminal 70 is also fixed in a caulking manner by the terminal caulking projections 57*b* and the auxiliary caulking projections 58*b* (see FIG. 3).

The first conductive terminal 60 and the second conductive terminal 70 may be produced using the likes of a good conductor metal, for example, phosphor bronze, but the first conductive terminal 60 and the second conductive terminal 70 are made of any material. Moreover, the first conductive terminal 60 and the second conductive terminal 70 may be applied with the likes of Au plating, Ni plating, or Sn plating.

The piezoelectric sounding body 10 shown in FIG. 1 is manufactured by the following steps, for example.

First, in a first step, the lower case 50 shown in FIG. 4 and the first conductive terminal 60 and second conductive terminal 70 shown in FIG. 5 are prepared, and the first conductive terminal 60 and the second conductive terminal 70 are attached to the lower case 50. Note that the upper case 40 and the lower case 50 are manufactured by resin molding such as injection molding, for example, and the first conductive terminal 60 and the second conductive terminal 70 are manufactured by mechanically processing a flat metal plate whose surface has been plated, for example.

FIG. 8 is a conceptual diagram showing how the first conductive terminal 60 is attached to the lower case 50. In attachment of the first conductive terminal 60 to the lower case 50, first, as shown in FIG. 8A, the first conductive terminal 60 is passed through the first terminal insertion hole 54*a* of the lower case 50 in a state where the first conductive terminal 60 is inclined. Next, as shown in FIG. 8B, while bringing the sandwiching portion 62*b* into contact with the lower case inner wall surface 52, inclination of the first conductive terminal 60 is reduced, and the contacting part 62*a* is brought closer to the lower case inner wall surface 52.

Figure 8A:
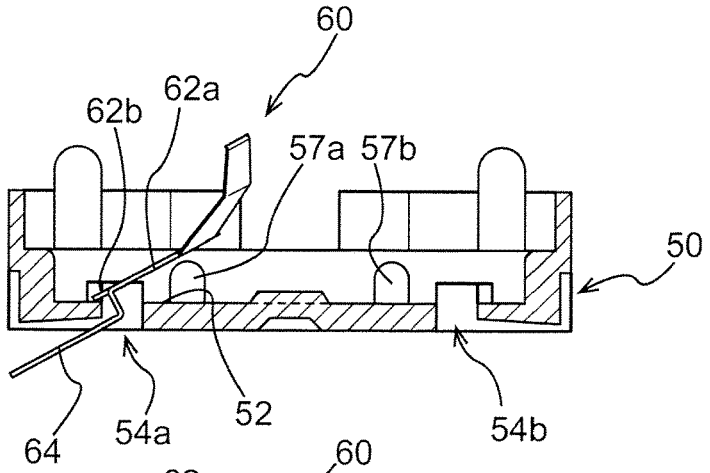
FIG. 8A to FIG. 8D are a conceptual diagram explaining a step of attaching a conductive terminal to the lower case.
Figure 8B:
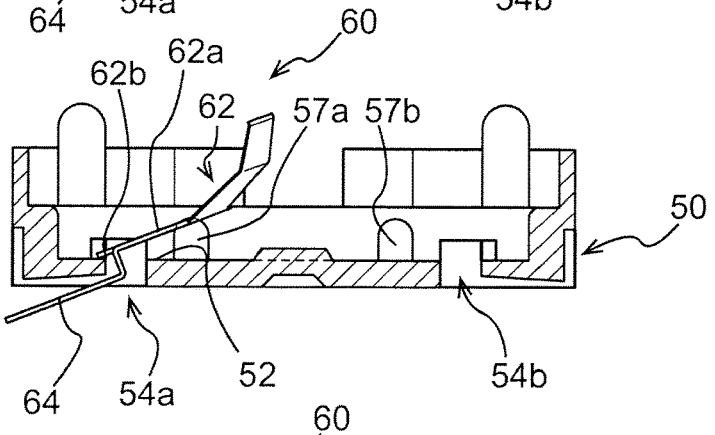
Figure 8C:
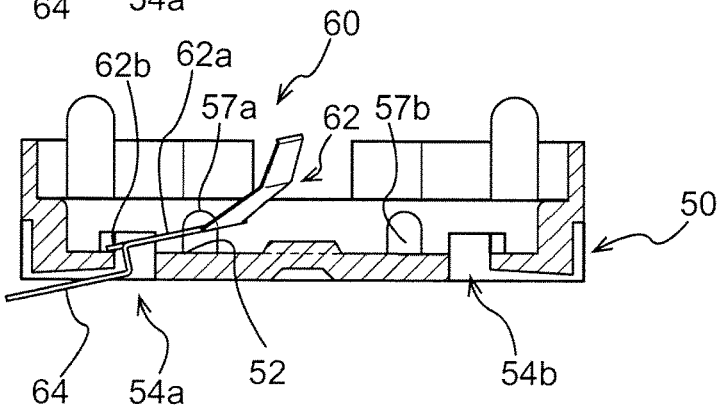
Figure 8D:
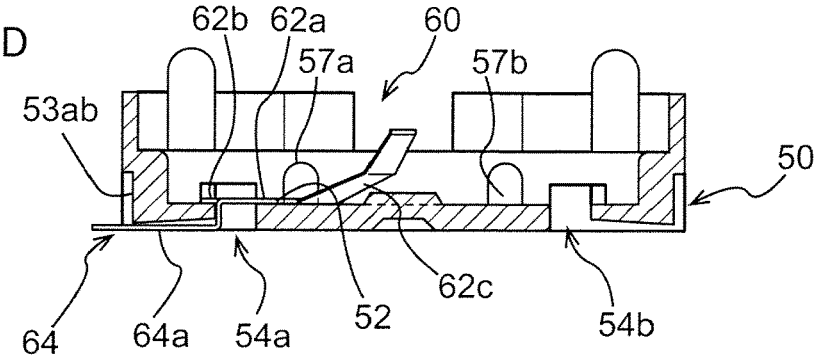

Next, as shown in FIG. 8C, while passing the terminal caulking projection 57*a* through the fixing hole 62*aa* formed in the contacting part 62*a*, inclination of the first conductive terminal 60 is further reduced. Finally, as shown in FIG. 8D, the contacting part 62*a* is brought into contact with the lower case inner wall surface 52, whereby attachment of the first conductive terminal 60 to the lower case 50 is completed. The second conductive terminal 70, after having been passed through the second terminal insertion hole 54*b*, is also attached to the lower case 50 similarly to the first conductive terminal 60.

Next, in a second step, the first conductive terminal 60 and the second conductive terminal 70 are fixed in a caulking manner to the lower case 50. Specifically, tips of the terminal caulking projections 57*a* and 57*b* of the lower case 50 are heated and thereby deformed so as to be larger than the fixing holes 62*aa* and 72*aa* of the first conductive terminal 60 and the second conductive terminal 70. In addition, the auxiliary caulking projections 58*a* and 58*b* are heated and thereby deformed, such that as shown in FIG. 3, parts of the auxiliary caulking projections 58*a* and 58*b* contact upper surfaces of the contacting parts 62*a* and 72*a* and the sandwiching portions 62*b* and 72*b*. As a result, as shown in FIG. 4, an intermediate product in which the first conductive terminal 60 and the second conductive terminal 70 are fixed in a caulking manner to the lower case 50, is produced.

Next, in a third step, the intermediate product produced in the second step, the piezoelectric vibrating plate 20, and the upper case 40 are prepared, and these three members are assembled as shown in FIG. 2 and FIG. 7. The piezoelectric vibrating plate 20 is produced by joining the piezoelectric body 22 where the electrode 22*a* is formed to the vibrating plate 24. The piezoelectric body 22 and the vibrating plate 24 may be joined by adhering the two with the likes of an epoxy adhesive agent, for example, but the piezoelectric body 22 and the vibrating plate 24 are joined by any method.

In the third step, the terminal tips 62*ca* and 72*ca* of the first conductive terminal 60 and the second conductive terminal 70 in the prepared intermediate product are coated with a conductive adhesive agent. Next, the piezoelectric vibrating plate 20 is brought close from above the intermediate product and placed in the lower case step part 51 of the lower case 50, further, the upper case 40 is brought close to the lower case 50 from above the piezoelectric vibrating plate 20, and the engaging parts 46*a* and 46*b* are engaged with the guide parts 56*a* and 56*b* of the lower case 50 as shown in FIG. 7, thereby assembling the upper case 40 and the lower case 50.

Note that prior to assembly of the upper case 40 and the lower case 50, at least one of a peripheral part of the upper surface of the piezoelectric vibrating plate 20 and the contact projection 45 of the upper case 40 may be coated with a resin such as silicone. After the third step, the coated silicone is cured by heating, whereby the problem of a gap being formed between the piezoelectric vibrating plate 20 and the contact projection 45 can be prevented, and the problem of the piezoelectric sounding body 10 becoming unable to generate a desired sound can be prevented.

In a fourth step, an edge of the case caulking projection 56 is heated and thereby deformed so as to be larger than a diameter of the insertion hole formed in the engaging parts 46*a* and 46*b*, whereby the upper case 40 is fixed to the lower case 50. Moreover, when the upper case 40 is fixed to the lower case 50, the piezoelectric vibrating plate 20 is sandwiched by the upper case 40 and the lower case 50 and fixed to the case 30. Furthermore, by the conductive adhesive agent coated on the terminal tips 62*ca* and 72*ca* of the first conductive terminal 60 and the second conductive terminal 70 being cured after being brought into contact with the piezoelectric vibrating plate 20, the terminal tips 62*ca* and 72*ca* and the piezoelectric vibrating plate 20 are connected.

After going through such steps, the piezoelectric sounding body 10 shown in FIG. 1 is manufactured. Note that a step in which parts of the second terminal portions 64 and 74 in the first conductive terminal 60 and second conductive terminal 70 are bent upwards to configure the lateral part 64*b* shown in FIG. 1 may be performed at the end of the first step, and moreover, may be performed in the second through fourth steps performed after the first step.

As shown in FIG. 2 and FIG. 3, the piezoelectric sounding body 10 sandwiches part of the case 30 by the sandwiching portions 62*b* and 72*b* of the first and second conductive terminals 60 and 70 arranged on the inside of the case 30 and the second terminal portions 64 and 74 arranged on the outside of the case 30. In addition, the contacting part 62*a* and the sandwiching portion 62*b* arranged on both sides sandwiching the terminal insertion holes 54*a* and 54*b* are both supported by the lower case inner wall surface 52. As a result, an external force applied to the second terminal portions 64 and 74 is received by the case 30, and the problem of the conductive terminals 60 and 70 moving inside the case 30 by the external force can be prevented. Thus, in the piezoelectric sounding body 10, the problem of an electrical connection state between the piezoelectric vibrating plate 20 and the conductive terminals 60 and 70 deteriorating due to the conductive terminals 60 and 70 moving inside the case 30 by an external force, can be prevented. Moreover, even when an external force is applied, it is difficult for a fixed state of the conductive terminals 60 and 70 to the case 30 to change, and hence the piezoelectric sounding body 10 displays high reliability and durability performance.

Moreover, as shown in FIG. 2, the piezoelectric sounding body 10 has a shape that not only sandwiches the lower case 50 between the sandwiching portions 62*b* and 72*b* of the first terminal portions 62 and 72 and the downside parts 64*a* and 74*a* of the second terminal portions 64 and 74, but sandwiches the lower case 50 also between the third terminal portions 66 and 76 and the lateral part 64*b* of the second terminal portions 64 and 74. Thus, in the piezoelectric sounding body 10, many portions of the conductive terminals 60 and 70, such as the first terminal portions 62 and 72 excluding the contact-point parts 62*c* and 72*c*, the second terminal portions 64 and 74, and the third terminal portions 66 and 76, contact the case 30 from a variety of directions, and hence an external force applied to the second terminal portions 64 and 74 is preferably received by the case 30.

As shown in FIG. 3, in the piezoelectric sounding body 10, the contacting parts 62*a* and 72*a* extending in the same plane as the sandwiching portions 62*b* and 72*b* are fixed to the lower case inner wall surface 52, and hence an external force applied to the second terminal portions 64 and 74 can be preferably received by the lower case 50. Thus, the following problem can be prevented: on the inside of the case 30, an external force is transmitted to a joining part of the contact-point parts 62*c* and 72*c* extending upwardly from the contacting parts 62*a* and 72*a* and the piezoelectric vibrating plate 20, and the joining part is thereby damaged. Moreover, since the contacting parts 62*a* and 72*a* are fixed in a caulking manner to the lower case 50, the lower case 50 and the contacting parts 62*a* and 72*a* are fixed with simplicity and high reliability.

As shown in FIG. 3, in the piezoelectric sounding body 10, the conductive terminals 60 and 70 are fixed in a caulking manner by the terminal caulking projections 57*a* and 57*b* being inserted into the plurality of fixing holes 62*aa* and 72*aa* formed in the contacting parts 62*a* and 72*a*, and hence the conductive terminals 60 and 70 can be effectively prevented from rotating due to an external force or the like. When attaching the conductive terminals 60 and 70 to the lower case 50, the conductive terminals 60 and 70 can be simply arranged in a correct position merely by inserting the terminal caulking projections 57*a* and 57*b* prior to having their tips deformed, into the fixing holes 62*aa* and 72*aa* of the contacting parts 62*a* and 72*a*, and hence this kind of piezoelectric sounding body 10 can be easily manufactured.

As shown in FIG. 5, in the piezoelectric sounding body 10, the contact-point parts 62*c* and 72*c* of the conductive terminals 60 and 70 have a shape that becomes narrower toward the terminal tips 62*ca* and 72*ca*. Thus, the contact-point parts 62*c* and 72*c* have a high flexibility, and conduction can be secured in a state where vibration of the piezoelectric vibrating plate 20 is unhindered. Moreover, even in the case when an external force that was unable to be received by the case 30 has been transmitted to the contact-point parts 62*c* and 72*c*, the narrowed contact-point parts 62*c* and 72*c* elastically deform, whereby the external force can be prevented from being transmitted farther to the tip side than a deformed place, and the problem of damage, and so on, occurring in a joining portion between the contact-point parts 62*c* and 72*c* and the piezoelectric vibrating plate 20, can be prevented.

As shown in FIG. 5, in the piezoelectric sounding body 10, by the contact-point parts 62*c* and 72*c* extending in a direction intersecting the first direction, a length from the portion fixed in a caulking manner to the terminal tips 62*ca* and 72*ca* can be increased, whereby appropriate springiness can be provided to the contact-point part 62*c*. Moreover, the problem of the terminal caulking projections 57*a* and 57*b* interfering with a movable range of the contact-point parts 62*c* and 72*c* to cause a defective product, can be reduced.

As shown in FIG. 6, the third terminal portions 66 and 76 of the conductive terminals 60 and 70 have formed therein the through hole 66*a* corresponding to a shape of the sandwiching portions 62*b* and 72*b*, and such conductive terminals 60 and 70 can be easily formed by mechanically processing a single metal plate. Such conductive terminals 60 and 70 do not have a joining portion resulting from the likes of welding or adhesion, hence have high strength and excellent durability.

As above, the piezoelectric sounding body according to the present invention was described showing an embodiment. However, the technical scope of the present invention is not limited to the piezoelectric sounding body 10 according to the embodiment, and it goes without saying that various modified examples altering the configuration of part of the piezoelectric sounding body 10 are also included in the technical scope of the invention. For example, shapes of the upper case 40 and the lower case 50, shapes of the conductive terminals 60 and 70, the numbers and positions of the terminal caulking projections 57*a* and 57*b*, and so on, can be changed according to design conditions, and so on.

In addition, for example, relative positions of the first terminal insertion hole 54*a* and the terminal caulking projection 57*a* and relative positions of the second terminal insertion hole 54*b* and the terminal caulking projection 57*b* may be made different. In this case, formation positions of the fixing holes 62*aa* and 72*aa* in the conductive terminals 60 and 70 are also made different for the first conductive terminal 60 and the second conductive terminal 70, based on the relative positions of the terminal insertion holes 54*a* and 54*b* and the terminal caulking projections 57*a* and 57*b*. By adopting such a shape, the problem that during assembly, the first conductive terminal 60 and the second conductive terminal 70 end up being assembled arranged in a mistaken position, can be prevented.

DESCRIPTION OF THE NUMERALS

10 . . . piezoelectric sounding body
20 . . . piezoelectric vibrating plate
22 . . . piezoelectric body
22*a* . . . other electrode
24 . . . vibrating plate
30 . . . case
40 . . . upper case
42 . . . sound emitting hole
44 . . . cylindrical part
45 . . . contact projection

46*a*, 46*b* . . . engaging part
50 . . . lower case
50*a* . . . center
51 . . . lower case step part
52 . . . lower case inner wall surface
52*a* . . . inner wall first portion
52*b* . . . inner wall second portion
53 . . . lower case outer wall surface
53*a* . . . downside recess
53*b* . . . lateral recess
54*a*, 54*b* . . . terminal insertion hole
56 . . . case caulking projection
56*a*, 56*b* . . . guide part
57*a*, 57*b* . . . terminal caulking projection
58*a*, 58*b* . . . auxiliary caulking projection
59 . . . notch
60, 70 . . . conductive terminal
62, 72 . . . first terminal portion
62*a*, 72*a* . . . contacting part
62*aa*, 72*aa* . . . fixing hole
62*b*, 72*b* . . . sandwiching portion
62*c*, 72*c* . . . contact-point part
62*ca*, 72*ca* . . . terminal tip
64, 74 . . . second terminal portion
64*a*, 74*a* . . . downside part
64*b* . . . lateral part
66 . . . third terminal portion
66*a* . . . through hole

The invention claimed is:

1. A piezoelectric sounding body, comprising:
a piezoelectric vibrating plate;
a case housing the piezoelectric vibrating plate;
a first conductive terminal electrically connected to one electrode in the piezoelectric vibrating plate; and
a second conductive terminal electrically connected to the other electrode in the piezoelectric vibrating plate,
wherein at least one of the first conductive terminal and the second conductive terminal including:
a first terminal portion arranged inside the case;
a second terminal portion arranged on the outside of the case; and
a third terminal portion arranged in a terminal insertion hole formed on a bottom surface being parallel to the piezoelectric vibrating plate in the case to connect the first terminal portion and the second terminal portion, and
the first terminal portion includes a sandwiching portion configured to extend along a plane parallel to a plane of the second terminal portion and sandwich a part of the bottom surface of the case between the sandwiching portion and the second terminal portion.

2. The piezoelectric sounding body according to claim 1, wherein the first terminal portion includes:
a contacting part configured to extend in the same plane as the sandwiching portion and be fixed in a caulking manner so as to contact an inner wall surface at the bottom surface of the case; and
a contact-point part configured to connect the contacting part and the piezoelectric vibrating plate.

3. The piezoelectric sounding body according to claim 2, wherein the contact-point part extends a direction crossing a first direction defined as an arrangement direction of the sandwiching portion and the contacting part when the first terminal portion is viewed from a normal direction of an arrangement surface of the sandwiching portion and the contacting part.

4. The piezoelectric sounding body according to claim 2, wherein the contacting part is in contact with a portion of the inner wall surface positioned at one side to the terminal insertion hole, and the sandwiching portion is in contact with a portion of the inner wall surface positioned at the other side to the terminal insertion hole.

5. The piezoelectric sounding body according to claim 3, wherein the contacting part is in contact with a portion of the inner wall surface positioned at one side to the terminal insertion hole, and the sandwiching portion is in contact with a portion of the inner wall surface positioned at the oside to the terminal insertion hole.

6. The piezoelectric sounding body according to claim 2, wherein the contact-point part has a shape configured to become narrower from the contacting part toward the piezoelectric vibrating plate.

7. The piezoelectric sounding body according to claim 3, wherein the contact-point part has a shape configured to become narrower from the contacting part toward the piezoelectric vibrating plate.

8. The piezoelectric sounding body according to claim 4 wherein the contact-point part has a shape configured to become narrower from the contacting part toward the piezoelectric vibrating plate.

9. The piezoelectric sounding body according to claim 5, wherein the contact-point part has a shape configured to become narrower from the contacting part toward the piezoelectric vibrating plate.

10. The piezoelectric sounding body according to claim 2, wherein a caulking projection configured to form a plurality of fixing holes on the contacting part and to fix the contacting part to the inner wall surface is inserted into the fixing hole.

11. The piezoelectric sounding body according to claim 3, wherein a caulking projection configured to form a plurality of fixing holes on the contacting part and to fix the contacting part to the inner wall surface is inserted into the fixing hole.

12. The piezoelectric sounding body according to claim 4, wherein a caulking projection configured to form a plurality of fixing holes on the contacting part and to fix the contacting part to the inner wall surface is inserted into the fixing hole.

13. The piezoelectric sounding body according to claim 5, wherein a caulking projection configured to form a plurality of fixing holes on the contacting part and to fix the contacting part to the inner wall surface is inserted into the fixing hole.

14. The piezoelectric sounding body according to claim 6, wherein a caulking projection configured to form a plurality of fixing holes on the contacting part and to fix the contacting part to the inner wall surface is inserted into the fixing hole.

15. The piezoelectric sounding body according to claim 7, wherein a caulking projection configured to form a plurality of fixing holes on the contacting part and to fix the contacting part to the inner wall surface is inserted into the fixing hole.

16. The piezoelectric sounding body according to claim 8, wherein a caulking projection configured to form a plurality of fixing holes on the contacting part and to fix the contacting part to the inner wall surface is inserted into the fixing hole.

17. The piezoelectric sounding body according to claim 9, wherein a caulking projection configured to form a plurality of fixing holes on the contacting part and to fix the contacting part to the inner wall surface is inserted into the fixing hole.

18. The piezoelectric sounding body according to claim 1, wherein the second terminal portion includes:

a downside part configured to be parallel to the sandwiching portion and to contact an outer wall surface of the case; and a lateral part configured to be parallel to the third terminal portion and to contact the outer wall surface.

19. The piezoelectric sounding body according to claim 1, wherein a through hole corresponding to a shape of the sandwiching portion is formed on the third terminal portion.

20. The piezoelectric sounding body according to claim 1, wherein the case includes:

a lower case where the first conductive terminal and the second conductive terminal are fixed; and an upper case configured to be fixed in a caulking manner to the lower case and to sandwich the piezoelectric vibrating plate between the upper case and the lower case.

* * * * *